United States Patent [19]

Banks

[11] 4,373,991

[45] Feb. 15, 1983

[54] METHODS AND APPARATUS FOR POLISHING A SEMICONDUCTOR WAFER

[75] Inventor: Edward L. Banks, Willingboro Township, Burlington County, N.J.

[73] Assignee: Western Electric Company, Inc., New York, N.Y.

[21] Appl. No.: 343,604

[22] Filed: Jan. 28, 1982

[51] Int. Cl.[3] ..... B24B 5/00; B24B 1/00; H01L 21/306

[52] U.S. Cl. ..... 156/645; 51/134.5 R; 51/281 R; 156/662

[58] Field of Search ..... 156/636, 637, 639, 645, 156/662, 345; 51/2 G, 55, 71, 98 R, 131.1, 134.5 R, 166 T, 216 T, 181 R, 281 R, 281 SF, 316, 317, 327, 328

[56] References Cited

U.S. PATENT DOCUMENTS

| | | | |
|---|---|---|---|
| 3,063,206 | 11/1962 | Meyerhoff et al. | 51/161 |
| 3,549,439 | 12/1970 | Kaneggia et al. | 156/636 |
| 3,930,914 | 1/1976 | Hetrich | 156/626 |
| 4,021,278 | 5/1977 | Hood et al. | 156/626 |
| 4,165,252 | 8/1979 | Gibbs | 156/345 |
| 4,256,535 | 3/1981 | Banks | 156/645 |

*Primary Examiner*—William A. Powell
*Attorney, Agent, or Firm*—D. J. Kirk

[57] ABSTRACT

A semiconductor wafer (31) is placed in a holder (10) and then positioned on a polishing pad (35) in a polishing machine (40). A mechanical force is applied to the holder (10) to cause a predetermined pressure on the wafer (31) therein as the polishing pad (35) is rotated. Simultaneously, water at a pressure slightly higher than the pressure applied to the wafer (31) is injected into the holder to form a water bearing layer between the wafer and the holder that permits free floating rotative motion of the wafer as it is being polished.

5 Claims, 5 Drawing Figures

METHODS AND APPARATUS FOR POLISHING A SEMICONDUCTOR WAFER

TECHNICAL FIELD

The invention is related to semiconductor processing. In particular, the invention is directed to polishing of a semiconductor wafer to a high degree of flatness.

BACKGROUND OF THE INVENTION

In the electronics industry there is a consistent trend to increase the number of devices that can be formed on a semiconductor wafer. This requires that extremely small line widths be photolithographically printed on the wafer. However, most photolithographic techniques are limited by the degree of flatness of the wafer surface for the depth of focus of projection printers cannot be adjusted to compensate for surface variation which restricts the resolution of the fine line patterns.

The last step in most semiconductor fabrication processes, prior to forming devices on a wafer, is to polish the wafer to as high a degree of flatness as possible. One well known technique is to place the wafer between a stainless steel, polyurethane coated, holder and a polishing pad. The wafer is tightly held by the polyurethane coating while the holder and the pad are rotated in same direction to polish the wafer. This technique results in variations of surface flatness of approximately eight microns. Such variations result in decreased yields of acceptable devices as the number of devices per unit area increases.

One technique that overcomes the foregoing problem is described in U.S. Pat. No. 4,256,535 to E. L. Banks, which is assigned to the instant assignee and is incorporated by reference herein. That patent teaches the placing of a drop of liquid on a flat, non-porous substrate and positioning a wafer thereon. The wafer is then polished with a rotating polishing pad while the wafer is permitted free floating, rotating motion on a thin layer of water during the polishing. Such a technique has been found to be most effective when polishing at low pressures (e.g., 3 psi or less), however, when polishing wafers under higher pressures the wafer is forced through the thin liquid layer resulting in breakage and/or nonuniform flatness during the polishing operation. However, polishing wafers at such higher pressures is most desirable in that the time required to polish a wafer is substantially reduced.

Accordingly, there is a need for a high pressure semiconductor wafer polishing technique that can provide acceptable flatness variations of the wafer while substantially eliminating breakage.

SUMMARY OF THE INVENTION

The instant invention overcomes the foregoing problem by capturing the wafer between a holding means and a rotating polishing pad; and injecting a liquid, under pressure, between the wafer and the holding means to permit free floating rotative motion of the wafer during polishing.

DETAILED DESCRIPTION

Figure 1:
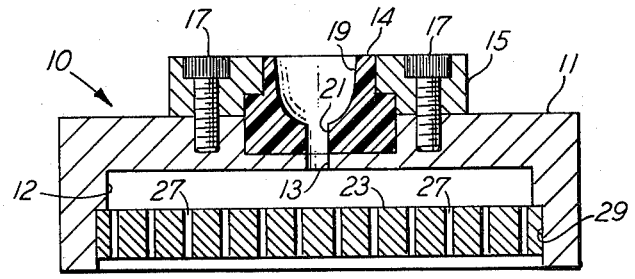
FIG. 1 is a cross-sectional view of the instant semiconductor wafer holder.
Figure 2:
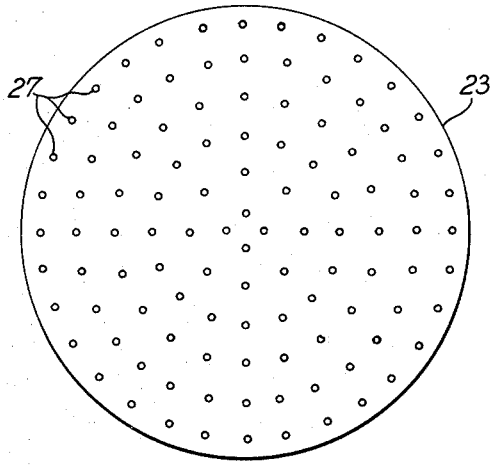
FIG. 2 is a plan view of an apertured plate used in the instant wafer holder.

A wafer holder, used to implement the instant high pressure semiconductor wafer polishing technique, is generally referred to by the numeral 10 in FIG. 1. The holder 10 is comprised of a metallic housing 11 having a recessed chamber 12 with an opening 13. A Teflon polymer insert 14 held in place by a metallic ring member 15 is anchored by a plurality of screws 17—17 at the top portion of the housing 11. The insert 14 has an outwardly flared opening 19 and a channel 21 extending from the bottom portion thereof which axially communicates with the opening 13 in the housing 11. A substantially flat plate 23, also shown in FIG. 2, having a plurality of channels 27—27 therethrough is press fit into a shoulder 29 in the lower portion of the housing 11.

In an exemplary embodiment, prior to the polishing operation a planar, substantially circular, silicon wafer 31 (see FIG. 5) having a diameter of three inches and a thickness of approximately 0.025 inch is placed in a double-sided planetary lapping machine (not shown) and lapped to a rough surface flatness of about one micron using an eleven micron aluminum oxide abrasive. The flatness of the lapped wafer is important for it has been found that the instant polishing technique will yield a smooth surface flatness no better than that of the lapped wafer 31. After the lapping step, the wafer 31 is etched to remove approximately two mils of material therefrom (i.e., one mil from each side). In a first embodiment the wafer 31 was etched in an acidic etch at 50° C. resulting in wafers emerging from the etchant at about 4 to 7 microns concave. In a second embodiment the wafer 31 was etched in a caustic etch at 90° C.; the wafer retained its original flatness of about one micron. In both embodiments the wafers 31—31 were immersed in the etchant for a time sufficient to remove approximately two mils of material from each wafer.

Figure 3:
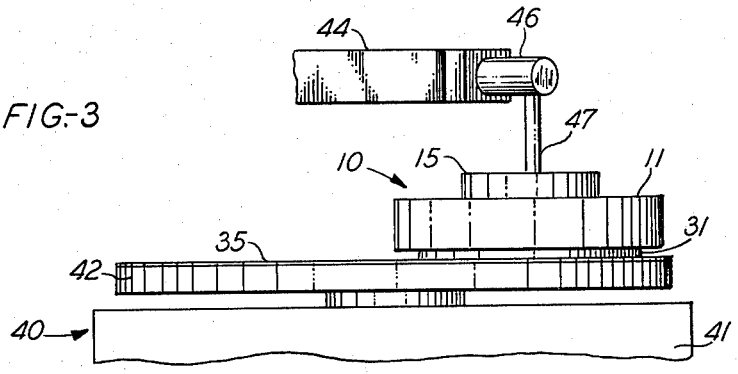
FIGS. 3 and 4 are side and plan views, respectively, of a semiconductor wafer polishing apparatus.
Figure 4:
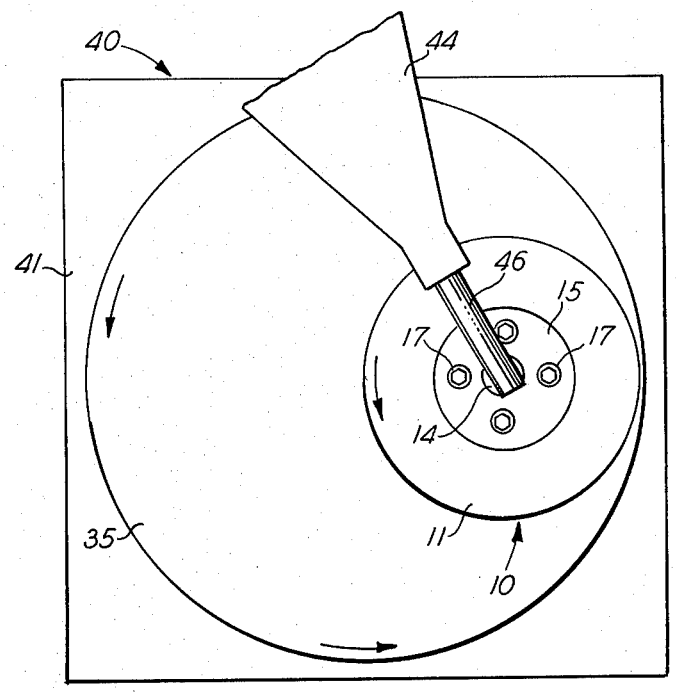
Figure 5:
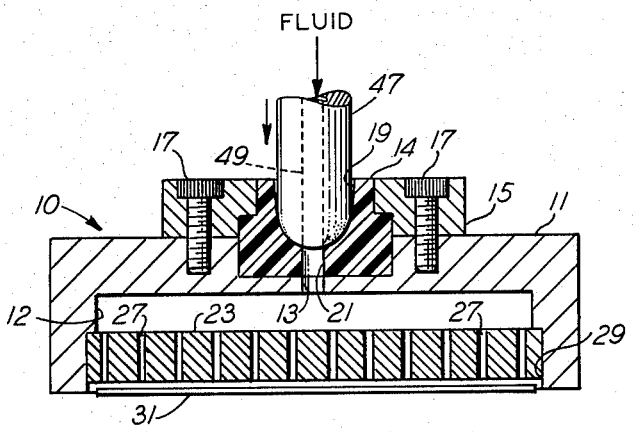
FIG. 5 is a partial cross-sectional view of the instant semiconductor wafer holder during the high pressure wafer polishing operation.

Upon completion of the etching step, the wafer 31 is placed on a polishing pad 35, with the holder 10 thereover, as can best be seen in FIGS. 3 and 5. The pad 35 is part of a polishing machine generally indicated by the numeral 40 in FIGS. 3 and 4. The polishing machine 40 is comprised of a base 41 and a rotatable polishing plate 42 with the polishing pad 35 thereon. The polishing machine 40 is a standard optical glass polishing machine modified with an eighteen inch diameter, one inch thick, plate 42. The machine 40 was purchased from R. Howard Strasbaugh, Inc. of Long Beach, Calif. An upper arm 44 of the machine 40 has an extension member 46 fixedly attached to a vertical rod 47 having a hemispherical end 49 (see FIG. 5) positioned in the flared opening 19 of the insert 14. Both the extension member 46 and the rod 47 are hollow and communicate with a pressurized water source (not shown).

In operation, the polishing plate 42 is rotated in a counterclockwise direction causing the holder 10 to also rotate counterclockwise about the rode 47. As can best be seen in FIG. 5 the wafer 31 has a diameter slightly less than plate 23. During the polishing operation a downward mechanical pressure of about 15 psi may be exerted on the wafer 31 to capture the wafer between the holder 10 and the rotating polishing pad 35.

Simultaneously, water, at a pressure slightly greater than 15 psi, is directed along a bore 49, through the channel 21 and the opening 13, into the chamber 12 and through the channels 27—27. The pressurized water ejected from the channels 27—27 acts as a bearing which urges the wafer 31 away from the surface of the plate 23 to permit a free floating rotative motion of the wafer as it is being polished. Additionally, the water flows out of the holder 10, between the lower surface of the shoulder 29 and the periphery of the wafer 31. Such outward flow precludes contact of the polishing compound with the surface of the plate 23 resulting in a wafer flatness of approximately 3 microns.

It is to be understood that the embodiment described herein is merely illustrative of the principles of the invention. Various modifications may be made thereto by persons skilled in the art without departing from the spirit and scope of the invention. In particular, although the instant invention is most advantageous for high pressure applications, it can also be used for low pressure (e.g., less than 3 psi) polishing of semiconductor wafers.

What is claimed is:

1. A method of polishing a wafer, comprising the steps of:

capturing the wafer between a holding means and a rotating polishing pad; and continuously injecting a liquid under pressure, between the wafer and the holding means to permit free floating rotative motion of the wafer during polishing.

2. A method of polishing a semiconductor wafer, comprising the steps of:

applying a pressure to the wafer by urging a holder, having a plurality of channels therethrough, towards a rotating polishing pad with the wafer interposed therebetween; and flowing a liquid, under a pressure greater than the applied pressure, through the channels to interpose a layer of liquid between the wafer and the holder to permit free floating rotative motion of the wafer during polishing.

3. Apparatus for polishing a wafer, comprising:

a rotatable polishing means;

means for holding the wafer on the polishing means; and means for injecting a liquid, under pressure between the holding means and the wafer to permit free floating, rotative motion of the wafer as the polishing means rotates to polish said wafer.

4. The apparatus as set forth in claim 3, wherein:

the holding means has a plurality of channels through which a liquid, under pressure, passes to inject the liquid between the holding means and the wafer.

5. The apparatus as set forth in claim 3, wherein:

the wafer is a semiconductor and the liquid is water.

* * * * *